United States Patent [19]

Isaacs et al.

[11] 3,969,709

[45] July 13, 1976

[54] WIRELESS BURGLAR ALARM SYSTEM

[76] Inventors: Roger Isaacs, 953 E. 9th St.; Albert Stern, 929 E. 18th St., both of Brooklyn, N.Y. 11230

[22] Filed: June 26, 1969

[21] Appl. No.: 836,848

[52] U.S. Cl. ..... 340/224; 325/57; 340/276; 343/228

[51] Int. Cl.[2] ..... G08B 5/22

[58] Field of Search ..... 340/224, 216, 416; 325/57; 343/228

[56] References Cited

UNITED STATES PATENTS

| | | | |
|---|---|---|---|
| 2,617,923 | 11/1952 | Rekart | 343/228 X |
| 3,051,934 | 8/1962 | Lesher | 340/224 |
| 3,207,850 | 9/1965 | Foreman | 340/224 X |
| 3,485,953 | 12/1969 | Norberg | 325/57 X |

*Primary Examiner*—David L. Trafton
*Attorney, Agent, or Firm*—Philip D. Amins

[57] ABSTRACT

A radio intrusion alarm system utilizing a high frequency carrier signal having an audio subcarrier which may be modulated by two tone signals, the first tone signal causing actuation of an alarm, the second tone signal causing actuation of a time delay means which inhibits operation of the alarm to permit an authorized entry, for example, at the transmitter location without giving the alarm.

49 Claims, 6 Drawing Figures

INVENTORS
ROGER ISAACS
ALBERT STERN
BY Lelling and Siegel
ATTORNEYS

INVENTORS
ROGER ISAACS
ALBERT STERN

BY

Lilling and Siegel
ATTORNEYS

INVENTORS
ROGER ISAACS
ALBERT STERN

BY Lilling and Siegel
ATTORNEYS

INVENTORS
ROGER ISAACS
ALBERT STERN

BY Lilling and Siegel
ATTORNEYS

WIRELESS BURGLAR ALARM SYSTEM

REFERENCE TO COPENDING APPLICATION

This invention relates to subject matter disclosed in Application Ser. No. 836,700, filed June 26, 1969.

BACKGROUND OF THE INVENTION

Prior art burglar alarm systems are tedious, expensive and difficult to install. If an alarm system is desired to be installed in a completed premises, it is necessary to drill holes, break plaster walls and install a fairly complex network of wiring through the interior walls of the premises. Thus, the owner and occupants of the premises are severely inconvenienced and the time and cost for the equipment and installation is quite appreciable.

The present invention pertains to a wireless burglar alarm system wherein a receiver is positioned remotely of a wireless transmitter or transmitters and is responsive to a signal transmitted thereto by the transmitter to selectively affect the operation of a warning device connected to a receiver output.

Transmitters of the type to be employed in the wireless burglar alarm system of the present invention are described in our presently pending patent application entitled Transmitter for Producing Complex Modulated Carrier Signals, Serial No. 836,700, filed on even date herewith.

The receiver circuit assembly of the present invention is adapted to receive and demodulate a complex signal having an rf component, a mid-range audio frequency component and a low frequency component and to supply said demodulated low frequency component to output circuits associated with the receiver to selectively activate and inhibit the activation of a warning device connected to the output of one of the associated circuits as a load device.

SUMMARY

It is, therefore, the primary object of the present invention to provide a new and novel wireless burglar alarm system.

It is another object of the present invention to provide receiver circuitry operable to demodulate a complex signal having these separable frequency components and for feeding the lowest frequency component thereof to associated output circuits to control the operation of a warning device remotely disposed from the transmitter sending said complex signal.

It is a more particular object of the present invention to provide a wireless burglar alarm system of the aforementioned type employing an audible warning device; e.g., a bell.

It is yet another object of the present invention to provide a new and novel receiver circuit assembly of the aforementioned type which is selectively operable to activate the audible warning device upon reception of the lowest frequency signal component at the output circuit thereof and to selectively inhibit the activation of, or render inoperative for a predetermined period of time, the audible warning device.

It is still a further object of the present invention to provide a new and novel wireless burglar alarm system employing a plurality of "traps", or triggerable wireless transmitters, wherein said traps are mounted in conjunction with doors and windows and under carpets and the like and are adapted to trigger their associated transmitters upon the presence of an intruder or burglar in the premises protected by the burglar alarm system.

It is still another object of the present invention to provide a burglar alarm system of the aforementioned type wherein the traps are constructed in a manner so that a particular door or window may be selectively retained in an open position for an indetermined period of time without activating the audible warning device of the burglar alarm system.

It is yet a further object of the present invention to provide a new and novel receiver circuit operable to demodulate a complex double modulated signal having three separable frequency components wherein a low frequency component is used to modulate a middle frequency component and the resultant modulated signal is used to further modulate a high frequency component.

These and other objects, features and advantages of the present invention will become more apparent from the detailed description to follow hereinafter, when considered in conjunction with the accompanying drawings wherein.

DESCRIPTION OF THE PREFERRED EMBODIMENT

Figure 1:
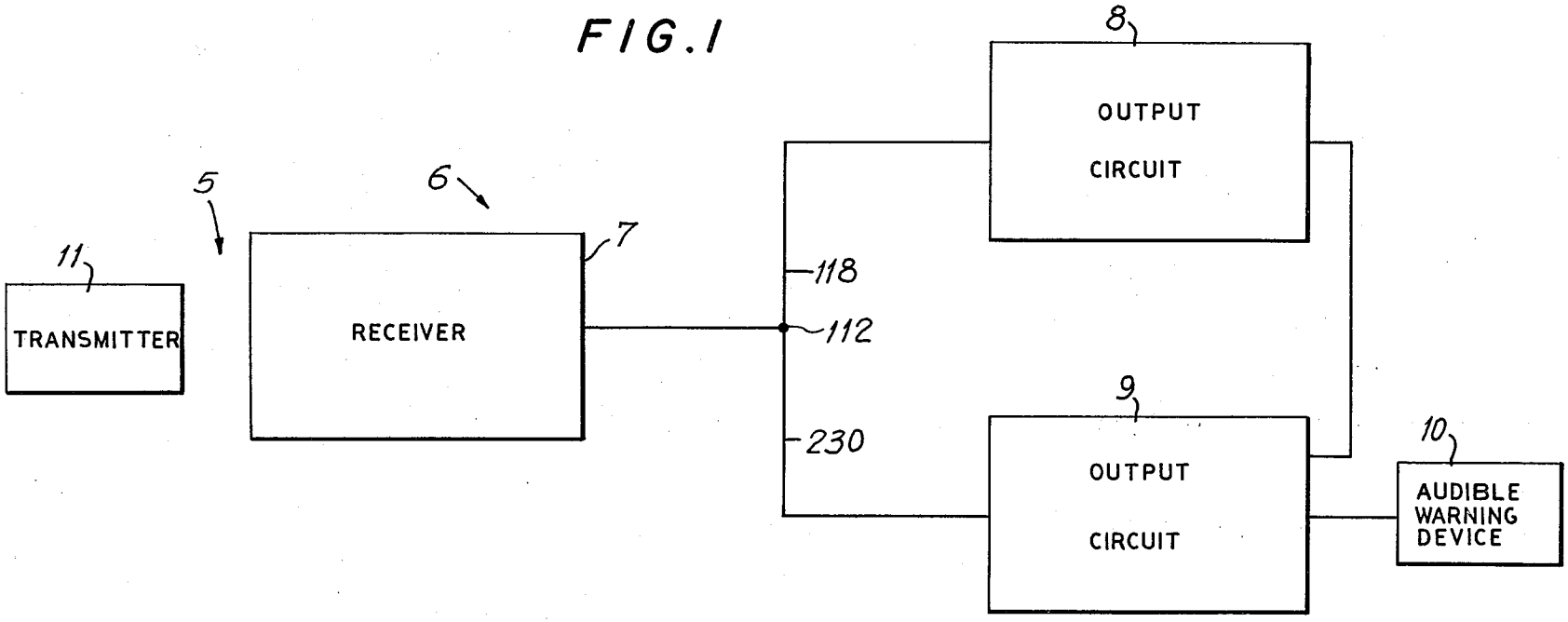
FIG. 1 is a block diagram depicting the various portions of the burglar alarm system of the present invention and, in particular, the receiver circuit assembly thereof.

Referring now to the drawings, and more particularly to FIG. 1 thereof, there is shown a burglar alarm system generally denoted by the reference numeral 5 and constructed in accordance with the principles of the present invention.

The burglar alarm system 5 includes a receiver circuit assembly generally denoted by the reference numeral 6. The circuit assembly 6 includes a receiver portion 7 having first and second output circuits 8 and 9, respectively, connected thereto. The output circuit 8 is connected to the output circuit 9, while the output circuit 9 has an audible warning device 10 connected as the output load thereof.

The burglar alarm system 5 also includes a wireless transmitter 11, which may be of the type described in our presently pending patent application entitled Transmitter for Producing Complex Modulated Carrier Signals, Ser. No. 836,700, filed on even date herewith.

Figure 2:
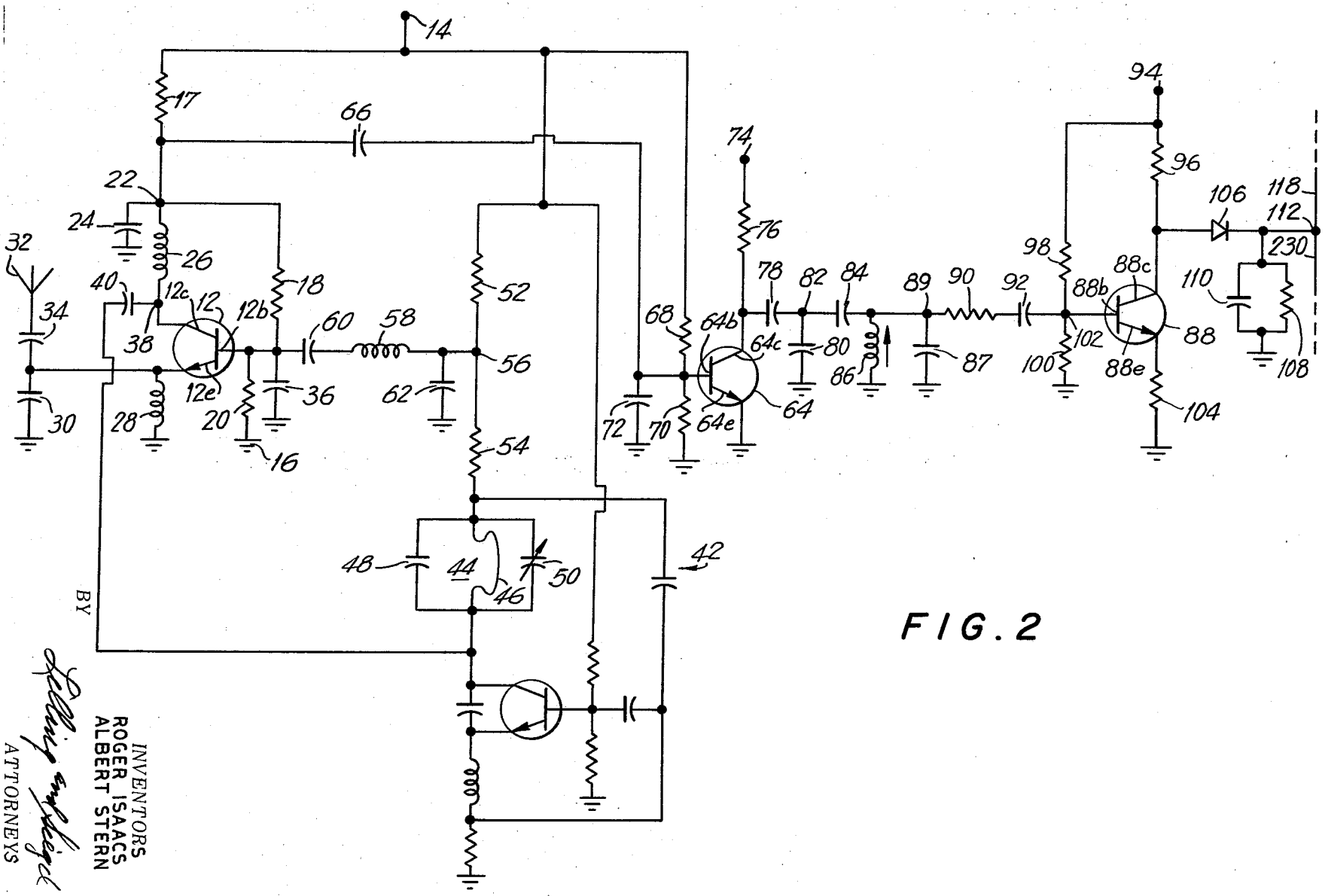
FIG. 2 is a schematic representation of the receiver circuit of the present invention.

With reference now to FIG. 2, the receiver 7 includes an rf input transistor amplifier 12 of the n-p-n type having a base 12*b*, a collector 12*c* and an emitter 12*e*. A source of B+ potential 14 provides the proper bias upon the base 12*b* by means of a voltage divider network connected between the source 14 and a ground terminal 16 and comprising the resistors 17, 18 and 20. The resistor 17 is connected between the source 14 and a junction point 22, the resistor 18 is connected between the junction 22 and the base 12*b* and the resistor 20 is connected between the base 12*b* and the ground terminal 16. The junction 22 is connected through a capacitor 24 to ground and through an rf choke 26 to collector 12*c*.

The emitter 12*e* is connected to ground by the parallel combination of an rf choke 28 and a capacitor 30. The emitter is also connected to a receiving antenna 32 by means of a capacitor 34. The capacitor 34 serves to isolate the emitter 12*e* from the antenna 32 and in conjunction with capacitor 30 forms a voltage divider network for feeding an input signal from the antenna to the emitter, in a manner to be described in more detail hereinafter.

A capacitor 36 is connected in parallel with the voltage dividing resistor 20 between the base 12*b* and ground, and the function of capacitor 36 will be described in detail in conjunction with the operation of the receiver, hereinafter.

The collector 12*c* is connected from a junction 38 through a coupling capacitor 40 to the output of a transistor oscillator circuit generally designated by the reference numeral 42. The oscillator includes an output tank circuit 44 comprising the parallel combination of an inductor 46 and capacitor 48 and including a variable capacitor 50 in parallel therewith, which capacitor is adapted to vary the frequency of oscillation to which the tank 44 is tuned and thus the frequency of oscillation of oscillator 42.

The output of the tank circuit is produced across the pair of resistors 52 and 54 whose junction 56 is connected to base 12*b* of transistor 12 through an rf choke 58 and a coupling capacitor 60. The junction 56 is also connected through a capacitor 62 to ground.

The collector 12*c* of transistor 12 is connected to the input of an n-p-n transistor amplifier designated generally by the reference numeral 64, by connecting the junction 22 through a coupling capacitor 66. A bias voltage is supplied to the base 64*b* of the transistor 64 by the B+ source 14 via the biasing resistors 68 and 70. The base is also connected to ground via a capacitor 72.

The collector 64*c* is forward biased by means of a B+ source 74 and biasing resistor 76 while the emitter 64*e* is connected directly to ground, whereby the amplifier 64 is connected in a common emitter configuration.

The output from transistor amplifier 64 is taken from collector 64*c* and the collector is connected to a pair of series connected capacitors 78 and 80. The junction 82 between capacitors 78 and 80 is connected to a series tuned circuit comprising a capacitor 84 and an inductor 86 and therefrom to the base 88*b* of an n-p-n transistor amplifier 88 through the series connection of a resistor 90 and a coupling capacitor 92. A capacitor 87 is connected between the junction 89 and ground.

The collector 88*c* is forward biased by connecting the same to a source of B+ potential 94 via a biasing resistor 96. The base 88*b* has a bias potential supplied thereto by means of biasing resistors 98 and 100 connected between source 94 and ground with the junction 102 between the resistors being connected to the base.

The emitter 88*e* is connected to ground through a resistor 104.

The output of transistor amplifier 88 is taken from collector 88*c* and is connected to the input of a demodulating diode 106 whose output is connected to the combination of a resistor 108 and capacitor 110 in parallel and the junction 112.

It is herein to be noted that the receiver circuit assembly 6 herein is for use with the remotely disposed transmitter 11, as will be described in more detail hereinafter. Since there are presently in existence various types of wireless transmission apparatus wherein a carrier wave is modulated by an information signal, it is extremely important that the signal transmitted to and adapted to be accepted by the present receiver assembly be significantly dissimilar from that transmitted by any other type of wireless transmission apparatus; one example of which is automatic garage door openers. Thus, the type of signal employed in the present invention is complex and comprises, in effect, a double modulated carrier wave. More particularly, an rf carrier is modulated by a mid-range audio frequency signal which in turn has been modulated by a low frequency signal component. Therefore, the receiver is operable to demodulate the complex signal and produce the resultant low frequency signal component as the output of the demodulator stage thereof and if a signal is received having only two of the three components thereof, the ultimate output of the receiver circuit assembly, i.e., the audible warning device will not be erroneously activated.

By way of illustration, the rf carrier wave may have a frequency in the 300 MHz. range, while the mid-range audio frequency may lie from between 10–20 KHz. and the low frequency component may be 200 or 100 Hertz, as will appear more fully hereinafter.

In the operation of the receiver 7, the composite signal is received by the antenna 32 and applied as an input signal to the emitter 12*e*. More particularly, and as discussed previously, the signal is an rf signal whose carrier frequency is in the 300 MHz. range and at this frequency the capacitor 36 has a very small reactance and effectively connects the base 12*b* to ground, whereby the amplifier 12 appears to have a grounded base configuration and the input signal is actually applied to the emitter-base circuit of the amplifier.

The input signal to amplifier 12 causes conduction therethrough and an output signal appears at the collector 12*c*. It is herein to be noted, however, that no output signal is produced across the resistor 17, at this time, so that the resistor 17 is not acting as an output resistor of the amplifier 12. This is due to the fact that at the frequency specified, the rf choke 26 prevents any signal conduction therethrough and further due to the fact that the junction 22 is effectively connected to ground by means of the capacitor 24, since at this frequency the reactance of capacitor 24 is negligible. It will also be appreciated that the grounded base configuration of the amplifier 12 presented to the input signal results in very little amplification of the input signal. Thus, the input signal, substantially as received, is presented at the collector 12*c* and is coupled via the coupling capacitor 40 to the output circuit of the oscillator 42 which is maintained in an oscillatory state by the components thereof and the B+ source 14. The application of the input signal from collector 12*c* to the output tank 44 of the oscillator 42 causes the amplitude of the oscillations across the tank to be greatly increased. It will, of course, be appreciated that during oscillation there is a high gain amplification produced across the output tank 44 and across the oscillator output which comprises the resistors 52 and 54. In practice, it has been found advisable to make resistors 52 and 54 equal so that one-half of the oscillator output voltage appears at junction 56.

The signal appearing at junction 56 is the amplified composite input signal whose rf carrier frequency has been verified as the correct frequency by virtue of the fact that it has produced a significant or appreciable signal amplitude at junction 56 by driving oscillator 42 into significant oscillation at the rf frequency to which it was tuned by means of its tank circuit 44. Stated alternatively, the oscillator circuit 42 is a synchronous oscillator which will pass an input signal applied to the output tank thereof across the oscillator load, comprising resistors 52 and 54, when the input signal is synchronized with the fundamental frequency of oscillation of the oscillator.

Referring now again to the signal appearing at junction 56, it is to be noted that the signal now passes to the base 12*b* of transistor amplifier 12. However, the rf carrier frequency is filtered out of the complex signal by means of the capacitor 62 and rf choke 58, which act as a filter network. At frequencies in the range of 300 MHz., the capacitor 62 acts as an rf bypass capacitor to ground and the choke 58 prevents any rf signal component from passing therethrough. Thus, the remaining signal comprises the mid-range audio frequency component and the low frequency component and is coupled to the base 12*b* by means of the coupling capacitor 60.

It is herein to be noted that the signal now appearing at the base 12*b* appears to be to the mid-range audio frequency component, as a carrier wave, and the low frequency component, as a modulating signal.

The audio frequency component which, as discussed hereinbefore, has a frequency of from 10–20 KHz., is actually impressed across the base to emitter circuit of the transistor amplifier 12, since at the audio frequencies specified the choke 28 appears to be a short circuit, thereby effectively connecting the emitter 12*e* to ground and transferring the transistor amplifier 12 into a grounded emitter configuration. It will also be appreciated that at these audio frequencies, the capacitor 36 appears as an open circuit to disconnect the base from ground, as distinguished with its function at rf frequencies where the capacitor acted as a short circuit.

The signal presented between the base and emitter circuit is then amplified by transistor 12 and appears as the output thereof on the collector 12*c*, and more particularly between the collector and emitter 12*e* which is connected to ground.

Since the highest frequency component of the signal appearing at the collector 12*c* is now in the audio frequency range, the capacitor 24 appears as an open circuit and choke 26 appears as a short circuit, whereby the output signal at collector 12*c* is now impressed across resistor 17 which acts as a load resistor for the amplifier 12. The signal impressed across load resistor 17 is then coupled via capacitor 66 as an input signal to the base 64*b* of the amplifier 64 connected in a grounded emitter configuration. The amplified signal is then presented upon the collector 64*c*, across load resistor 76, from where it is fed to a wave shaping or filtering network comprising the parallel combination of capacitors 78 and 80. The shaped or filtered signal which is then present at junction 82 is fed to the series tuned circuit comprising the capacitor 84 and inductor 86. The tuned circuit is tuned to the precise frequency of the audio frequency component of the signal, whereby the signal is effectively amplified thereby and then fed to the base 88*b* of the transistor amplifier 88 through a voltage dividing network comprising the resistors 90 and 100 and capacitor 92.

It is herein to be noted that the coil or inductor 86 has a capacitor 87 connected in parallel thereacross, the purpose of which is to compensate for any capacitance variations which may exist between different inductors 86 having the same inductance ratings.

It is also to be noted that the resistor 90, as well as serving as part of a voltage divider, serves to isolate the amplified voltage appearing at the junction 89 from the base 88*b* so as to provide, in conjunction with resistor 100, the correct driving signal to amplifier 88 to prevent the amplifier from being overdriven. The amplifier also includes a resistor 104 which is effectively connected between the emitter 88*e* and base 88*b* to provide negative feedback to the amplifier.

The amplified signal is then presented at collector 88*c* and across the load resistor 96 from whence it is fed to the demodulating circuit comprising the demodulating diode 106 and circuit comprising the parallel combination of the resistor 108 and capacitor 110. The demodulated signal comprising only the low frequency components is then present at the junction 112 from where it is then fed to activate what may be generally termed the receiver output circuit and which will now be described in detail.

The receiver output circuit comprises the first output circuit 8 and the second output circuit 9.

Figure 3:
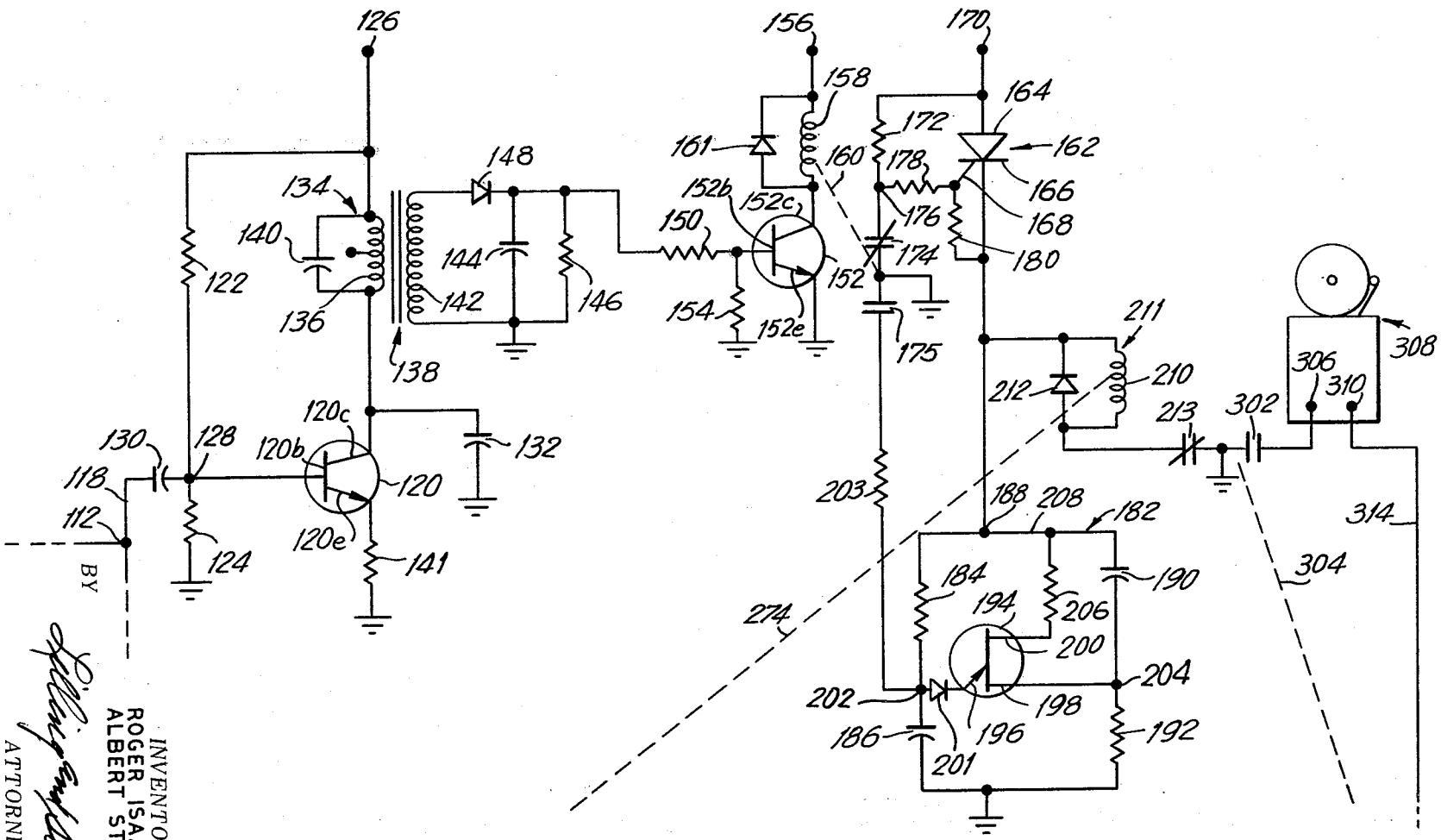
FIG. 3 is a schematic illustration of one of the associated output circuits connected to the receiver for controlling the inhibiting operation of the audible warning device.

With reference now to FIG. 3 and the output circuit 8, the junction 112 is connected to the circuit 8 via a lead line 118. The output circuit 8 includes a transistor amplifier 120 having a base 120*b*, an emitter 120*e* and a collector 120*c*. A bias potential is supplied to the base 120*b* by means of a voltage divider comprising resistors 122 and 124 connected between a B+ supply 126 and ground. The junction 128 between the resistors 122 and 124 being connected to the base 120*b* and to the lead line 118 through a coupling capacitor 130.

The collector 120 is connected to ground through a capacitor 132 and is also connected to the B+ supply 126 via a parallel tuned tank 134 comprising the parallel combination of the primary coil 136 of a transformer 138 and a capacitor 140. The emitter 120*e* is connected to ground through a feedback resistor 141. The secondary coil 142 of the transformer is connected across the parallel combination of a capacitor 144 and resistor 146 through a diode rectifier 148. The diode output, and thus the capacitor 144, is in turn connected through a resistor 150 to the base 152*b* of transistor 152, which base is connected to ground through another resistor 154.

The emitter 152*e* is connected directly to ground while the collector 152*c* is connected to a B+ supply 156 through the relay coil 158 of a relay 160. A negatively poled diode 161 is connected in parallel across coil 158. The circuit 8 also includes a silicon controlled rectifier 162, commonly termed an SCR which includes an anode 164, a cathode 166 and a gate 168. The anode 164 is connected to a B+ source 170 and also through a resistor 172 and the normally closed contacts 174 of the relay 160 to ground. The junction 176 between the resistor 172 and the contacts 174 is connected to the gate 168 through a resistor 178 and the gate 168 is connected through a resistor 180 to the cathode 166.

The cathode 166 is connected to a timing circuit generally designated 182. The timing circuit 182 includes a series connected resistor 184 and capacitor 186 which are connected between a junction point 188 and ground. Another series connected capacitor 190 and resistor 192 is also connected between junction 188 and ground, in parallel with the series combination of resistor 184 and capacitor 186.

The timing circuit 182 also includes a unijunction transistor 194 having an emitter 196 and first and second bases 198 and 200, respectively. The emitter 196 is connected through a diode 201 to the junction point 202 between resistor 184 and capacitor 186. The first base 198 is directly connected to the junction point 204 between capacitor 190 and resistor 192 while the second base 200 is connected by means of a resistor 206 to a conductor 208, or effectively to the junction 188. The junction 202 is also connected, via a current limiting resistor 203, to the normally open contacts 175 of relay 160, which contacts are also connected to ground.

The cathode 166 is also connected to one end of the relay coil 210 of a relay 211, the other end of the coil being connected to ground through a pair of normally closed contacts 213. A negatively poled diode 212 is also connected between the cathode 166 and ground through the contacts 213 and in parallel with the coil 210.

Figure 4:
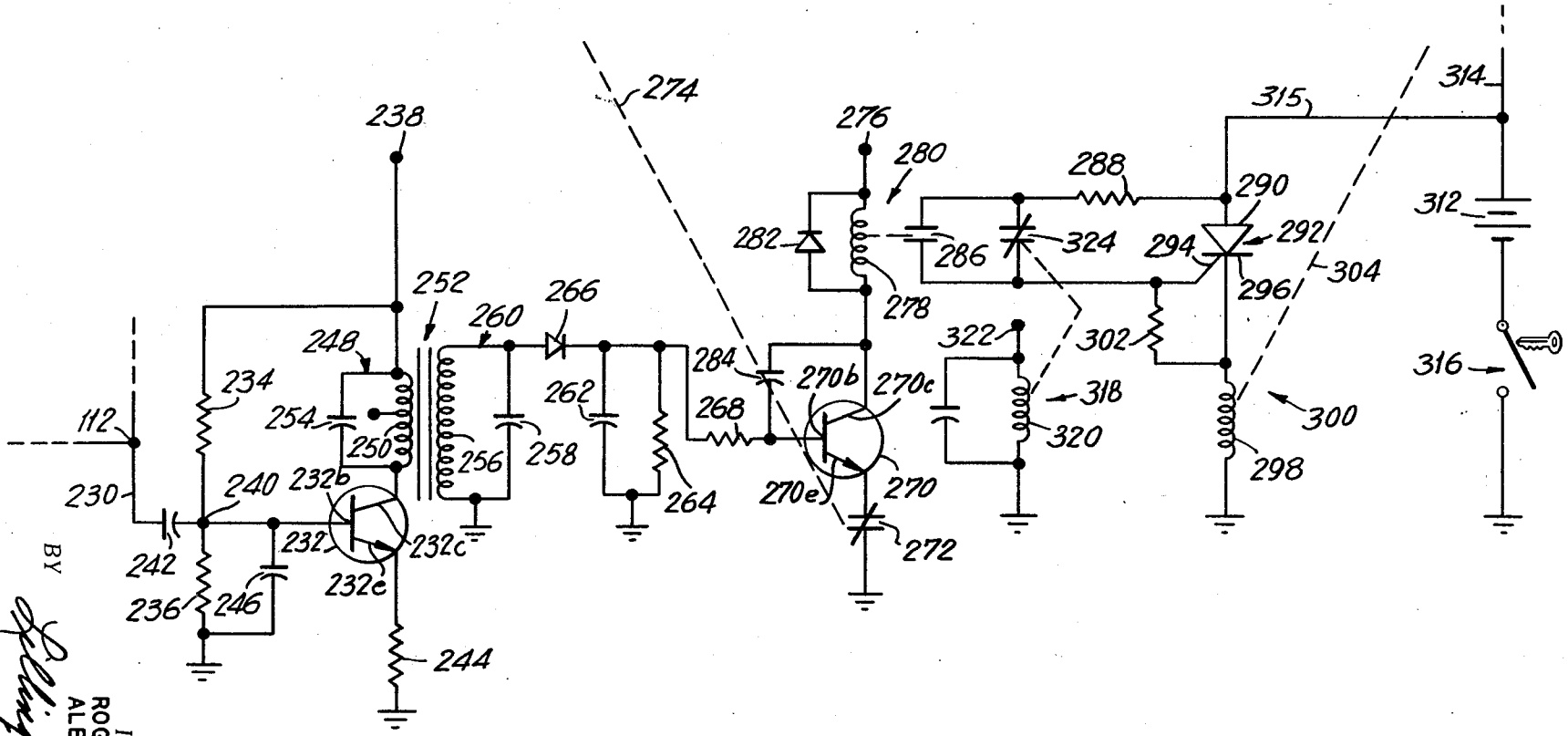
FIG. 4 is a schematic illustration of the other of the associated output circuits connected to the receiver for controlling the operation of the audible warning device.

Referring now to FIG. 4 and to the output circuit 9, the junction 112 is connected to the circuit 9 via a lead line 230. The output circuit 9 includes a transistor amplifier 232 having a base 232*b*, an emitter 232*e* and a collector 232*c*. A bias potential is supplied to the base 232*b* by means of a voltage divider comprising resistors 234 and 236 which resistors are connected between a B+ supply 238 and ground with the junction 240 between the resistors being connected to the base 232*b* and the lead line 230 through a coupling capacitor 242.

The emitter 232*e* is connected to ground through a feedback resistor 244 and capacitor 246 is connected in parallel across the resistor 236. The collector 232*c* is connected to B+ supply 238 via a parallel tuned tank 248 comprising the parallel combination of the primary coil 250 of a transformer 252 and a capacitor 254. The secondary coil 256 of the transformer has a capacitor 258 connected in parallel therewith which capacitor in conjunction with the secondary coil forms a parallel resonant tank 260 tuned to the same frequency as that of tank 248. The output of tank 260 is connected across the parallel combination of a capacitor 262 and a resistor 264 through a diode rectifier 266. The output from diode 266, and thus the capacitor 262, is connected through the resistor 268 to the base 270*b* of transistor 270. The emitter 270*e* is connected to ground through the normally closed contacts 272 of the relay 210 (see FIG. 3); the relay 210 is electro-magnetically coupled to the contacts 272 as schematically illustrated by the dotted lines 274, the purpose of which will appear in more detail hereinafter. The collector 270*c* is connected to a B+ source 276 through a relay coil 278 of a relay 280; the coil 278 has a negatively poled diode 282 connected in parallel therewith. A capacitor 284 is interconnected between the base 270*b* and the collector 270*c*.

The relay 280 has normally open contacts 286, one of which is connected through a resistor 288 to the anode 290 of an SCR 292, and the other of which is connected to the gate 294 of the SCR. The cathode 296 of the SCR 292 is connected to ground through the coil 298 of a relay 300; the cathode 296 is also connected to the gate 294 via a resistor 302. The relay 300 includes the normally closed contacts 213 and normally open contacts 302 (as seen in FIG. 3). The coil 298 is electro-magnetically coupled to the contacts 213 and 302, as schematically illustrated by the dotted lines 304. One of the terminals of the normally open contacts 302 is connected to ground and the other terminal thereof is connected to a terminal 306 of a bell 308. The other terminal 310 of the bell is connected to the positive terminal of a battery 312 via a lead line 314 while the negative terminal of the battery is connected to ground through a schematically illustrated key switch 316. The positive terminal of the battery 312 is also connected to the anode 290 of the SCR 292 via a lead line 315.

A relay 318 having a coil 320 connected to a B+ source 322 also includes a pair of normally closed contacts 324, more particularly the contacts are closed when there is no current flow through the coil 320. The normally closed contacts 324 are connected in parallel across the normally open contacts 286 of the relay 280. The coil 320 has a capacitor 326 connected in parallel therewith and whose purpose will be described in detail hereinafter. With reference to the operation of the output circuit 9, it is herein to be noted that a low frequency signal component has been presented at junction 112 and for purposes of illustration, it will be assumed that the particular frequency is 100 Hertz.

The 100 Hertz signal is coupled via a capacitor 242 to the base 232*b* of the transistor 232 and will cause the transistor to conduct. It is herein to be noted that the capacitor 246 acts as a filter to attenuate any frequencies in excess of 100 Hz.

When the transistor 232 conducts, an output signal appears across the tank 248 and since the tank is tuned to 100 Hz., all other frequencies will be attenuated thereby, so that the signal appearing across coil 250 and coupled to the coil 256 will be only that single component having the desired frequency. Moreover, the secondary coil 256 is tuned by means of capacitor 258 to form a secondary resonant tank circuit also tuned to 100 Hz. which further attenuates all other frequency components other than the desired 100 Hz. signal.

The signal appearing across the tank circuit 260 is fed to diode 266 which rectifies the signal and the rectified output signal is applied across capacitor 262 and charges the capacitor. The voltage appearing across capacitor 262 tends to discharge through resistor 264 which functions as a "bleed-off" resistor. However, the parallel combination of capacitor 262 and resistor 264 acts as a filter for the dc voltage appearing at the output of diode 266 and removes the ripple appearing in this voltage. The filtered dc voltage is applied across the resistor 268 and thus across the base to emitter junction of the transistor 270.

The voltage produced across resistor 268, and more particularly across the base to emitter junction of transistor 270, drives the transistor into conduction causing current flow from the source 276 through the relay coil 278 and through the normally closed contacts 272 to ground.

When current flows through the coil 278, it closes the normally open contacts 286. Closure of the contacts 286 results in current flow from the battery 312 through the resistor 288 and the closed contacts 286 to the gate 294 of the SCR 292 causing the SCR to fire. When the SCR fires, current flows from the anode 290 to the cathode 296 thereof and, thus, there is current flow through the coil 298 of the relay 300. The current flow through the relay coil 298 causes the normally closed contacts 213 (FIG. 3) to open and the normally open contacts 302 to close. Closure of the contacts 302 connects the terminal 306 of the bell 308 to ground and thereby complete the circuit from the battery 312 through the bell to ground, thereby activating the bell. The bell will remain activated until such time as the normally closed key switch 316 is opened by means of a special key, as shown in FIG. 4.

It is herein to be noted that the sources of supply have been schematically illustrated herein as B+ sources. However, the B+ potentials are obtained by means of a regulated power supply (not shown) connected to an AC source, which source is normally the line current in the premises to be protected. Thus, the system must include a means to activate the alarm should anyone tamper with the main current supply. For this purpose, the circuit is supplied with the relay 318. More particularly, the coil 320 of the relay is connected to the terminal 322 having a B+ potential thereat which is obtained from the regulated power supply which is in turn connected to the AC line. The contacts 324 are normally closed but maintained in an open condition by the relay 318 when current flows through the coil 320. Should the AC line be cut, there will no longer be a B+ potential supplied at the terminal 322 and thus there will no longer be any current flow through the coil 320. When this occurs, the contacts 324 will return to their normally closed position, whereupon current will flow from the battery 312 through the resistor 288 and thence through the closed contacts 324 to the gate 294 of the SCR 292, thereby causing the SCR to fire and to activate the bell 308, in the manner described hereinbefore.

It will be appreciated that any AC line will have transients or fluctuations therein which transients would normally affect the current flow through the coil 320 and thus possibly prematurely trigger the bell 308. For this purpose, a large capacitor 326 is connected in parallel across the coil 320, whereby if there are any transients or momentary power failures which would remove the B+ potential from the terminal 322, and would thereby tend to stop the current flow through the coil 320, capacitor 326 will maintain the current flow through the coil 320, for a period of time, normally in the order of three to five seconds. Thus, for any transient or momentary loss of power to terminal 322, there will not be any cessation of current flow through the coil 320, and thus, the contacts 324 will not return to their normally closed position. When the potential at terminal 322 has been restored to its proper operating value, the circuit will continue to operate in the desired manner.

It will be apparent that although we have shown and described an audible warning device, more particularly a bell 308, it is within the scope of the present invention to provide any type of warning device, whether it be audible or otherwise. For example, the warning device may be a light or it may be a transmitter to send a signal to a local police station or other protective agency to inform the proper personnel that an intruder has entered the premises protected by the burglar alarm system. It is also possible that the warning device be of the type wherein a telephone is activated to call a protective agency or the local police to inform them of the presence of an intruder.

With regard to the operation of the output circuit 8, it is herein to be noted that the signal transmitted to and adapted to be received by the receiver circuit assembly of the present invention, for activation of the circuit 8, contains a low frequency component different from the frequency to which circuit 9 is tuned. By way of example, the frequency of this low frequency component may be 200 Hz., while that to which circuit 8 is tuned may be 100 Hz. Thus, when it is desired to activate the circuit 8, to inactivate the bell, as will be explained in more detail hereinafter, a complex signal having a 200 Hz. component will be transmitted to and received by the receiver circuit assembly 6 and the 200 Hz. signal will appear at the junction 112.

The 200 Hz. signal present at junction 112 is coupled via capacitor 130 to the base **120*b* of transistor 120 and will drive the transistor into a conductive state. The output of the transistor will appear across the tank 134 and more particularly across primary coil 136.**

It is herein to be noted that the tank 134 is tuned to a frequency of 200 Hz. whereby the output of the transistor will appear across the coil 136 only if the input signal applied to base **120*b* is of substantially the same frequency as that to which the tank 134** is tuned.

The voltage produced across coil 136 is coupled by the transformer 138 to the secondary coil 142 and is rectified by diode 148 and applied across capacitor 144 charging the same. The signal then appearing across capacitor 144 is then fed via resistors 150 and 154 to the base **152*b* of transistor 152, and more particularly across the base to emitter circuit thereof to cause conduction of transistor 152. At the same time capacitor 144 is discharging itself through resistors 150, 154 and 146.**

Referring now to the SCR 162 it will be seen that with the contacts 174 of relay 160 closed, current flows from source 170 through resistor 172 and contacts 174 to ground. There is substantially no current flow through resistor 178 to the gate 168 of SCR 162 so that the SCR is in an off state and no current flows from the anode 164 to the cathode 166 thereof.

Conduction of transistor 152 results in current flow through the relay coil 158 thereby energizing relay 160 and causing the normally closed contacts 174 to open and the normally open contacts 175 to close. Opening of the contacts 174 results in the junction 176 no longer being clamped to ground, whereupon current flows through resistor 178 to the gate 168 of the SCR 162 causing it to fire. When the SCR fires, current flows from the anode 164 to the cathode 166 and thus there is current flow through the coil 210 of the relay 211 and through the normally closed contacts 213 to ground. The current flow through the coil 210 energizes relay 211 and causes the normally closed contacts 272 (FIG. 4) to open whereupon the emitter to ground circuit of the transistor 270 is placed in an open circuited, non-conductive condition. Since the transistor 270 is open circuited, any alarm signal which is applied to the base **270*b* of the transistor 270, during this time, will be unable to activate the alarm, or bell 308. In particular, since the emitter to ground circuit is open circuited, there can be no current flow from the source 276 through the relay coil 278 to ground. Thus, the contacts 286 cannot be closed to allow current to flow therethrough to the gate 294 of the SCR 292 to fire the same and ultimately activate the bell 308. This condition will be maintained as long as the relay 211 is activated and current flows through the coil 210.**

It is herein to be noted that the pulse applied to the transistor 152 has a very low PRF, normally in the order of one per minute so that when no further pulse is present at base 152*b*, the transistor 152 stops conducting whereupon current ceases to flow through coil 158 and the relay snaps back into its deenergized position with contacts 174 closed and contacts 175 open. Thus, there is no further current being fed to the gate 168; however, current flow through the SCR 162 will continue until the same is back biased. Therefore, since SCR 162 is maintained in its turned on state current will continue to flow therethrough and through the coil 210 of relay 211 to maintain the burglar alarm system, and more particularly, the bell 308, in an inhibited or inactivated condition.

With reference now to the timing circuit 182, as soon as the contacts 175 return to their normally open position, the junction 202 and thus capacitor 186 are no longer clamped to ground, whereupon the current flow through the SCR 162 to junction 188 commences to charge the capacitor 190. The values of the capacitor 190 and resistor 192 are chosen so that their time constant is extremely short so that the capacitor 190 are chosen so that their time constant is extremely short so that the capacitor 190 is almost instantaneously charged to the potential of the B+ source 170 upon conduction of SCR 162. Comcomitantly with the charging of capacitor 190, and as soon as the contacts 175 are opened so that junction 176 is no longer clamped to ground, capacitor 186 commences to charge in dependence upon the timing constant of the curve defined by the capacitor 186 in conjunction with the resistor 184, which time contant is appreciably greater than that defined by the capacitor 190 and resistor 192. The charging of capacitor 186 continues until the voltage thereacross is such that it provides a bias potential on emitter 196 which is sufficient to forward bias the emitter 196 to first base 198 circuit to cause conduction therethrough. It will be apparent, therefore, that the time required to initiate conduction of the unijunction transistor 194 is a function of the time constant curve of the resistor 184 and capacitor 186; whereby the values of these components may be selected so as to achieve the desired charging period, which period becomes the period of operation of the timing circuit 182.

Since the resistor 192 is connected at junction 204 between the base 198 and ground, conduction of the transistor 194 between its emitter and first base circuit, as described hereinabove, will cause the capacitor 186 to be connected across the resistor 192 and to discharge therethrough. The discharge of capacitor 186 is deemed the output pulse of the timing circuit 182 and causes the voltage on emitter 196 to be decreased, whereupon conduction between the emitter 196 and the first base 198 ceases.

As previously noted, the capacitor 190 had been charged to the potential of the voltage source 170, therefore, when the capacitor 186 discharges through the resistor 192, it produces a positive voltage pulse which will be in "series addition" with the voltage stored on the capacitor 190. At this time, the voltage appearing at junction 188 of the timing circuit 182, and thus at the cathode 166 of the SCR 162, is more positive than the B+ source voltage present at the anode 164 of the SCR 162 and thus back biases the SCR causing the same to be turned off. Turning off the SCR 162 results in the cessation of current flow through the coil 210 of the relay 211, whereupon the relay is de-energized and the contacts 272 (FIG. 4) snap back to their normally closed position thereby returning the circuit 9 to its normal state, whereupon a signal applied to the base 270*b* of the transistor 270 will be operative to activate the alarm bell 308.

It is herein to be noted that after the application of the incoming pulse from the junction 112 to the base 120b, the circuit 8 remains operative to inhibit the activation of the bell 308 for a period of time determined by the timing circuit 182, even though the duration of the signal pulse is extremely short and significantly less than the timing period of the timing circuit 182. Thus, the timing circuit 182 is adapted to terminate the inhibiting operation of the circuit 8 a predetermined time after the activation thereof, provided no further input signal appears at junction 112. If another pulse is received at the junction 112 and fed to the base 152*b*, prior to the time that the SCR 162 is turned off, as previously described, then the contacts 175 will bbe snapped into a closed position and will clamp the junction 202 and capacitor 186 to ground. This will cause the capacitor to discharge, whereupon the circuit 182 will again commence its timing operation, which occurs when the signal pulse ceases and the contacts 175 are again returned to their normally open position.

It is also to be noted that the relay coils 158 and 210 are provided with diodes 161 and 212, respectively, in parallel therewith which diodes prevent any transient surges from burning out the transistor 152 and SCR 162, respectively.

It is herein to be noted that the relay coil 210 is connected to ground through the normally closed contacts 213 of the relay 300, rather than directly to ground. This construction is preferred since it has been found that when the bell 308 is activated and turned off by means of the keyswitch 316, and the coil 210 is directly connected to ground, there is a surge current produced through coil 210 which falsely triggers the SCR 162 and inhibits the activation of the bell 308 when the same is undesired.

With the preferred construction, undesirable activation of the SCR 162 is prohibited due to the fact that when the alarm is activated the relay coil 210 is open circuited and subsequent de-energization of the alarm circuit is unable to provide any surge through the open circuited coil 210.

The coil 210 is not reconnected to ground through the contacts 213 until the transmitting traps are reset and the keyswitch 316 is again closed.

Figure 5:
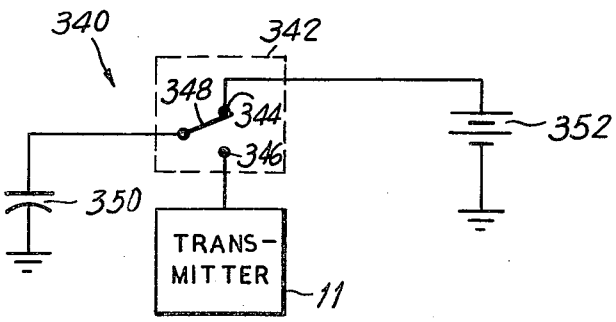
FIG. 5 is a schematic illustration of one form of trap used in conjunction with the burglar alarm system of the present invention.

Referring now to FIG. 5, there is shown a "trap", or triggerable wireless transmitter generally indicated by the reference numeral 340, which trap is used in conjunction with doors and windows. The trap 340 includes a magnetic switch 342 having contacts 344 and 346. The trap is shown in a condition corresponding to that when the door or window upon which it is mounted is in a closed position. The switch 342 also includes an arm 348 connected to a capacitor 350 and, in this position, the arm is connected to the terminal 344 which terminal is also connected to the positive terminal of a battery source 352. The other terminal 346 of the switch 342 is connected to a transmitter 11. In the position of the trap 340, illustrated in FIG. 5, wherein the door or window is in a closed position, the arm 348 connects the capacitor to the source 352 via the terminal 344 and the capacitor 350 is thus charged to the potential of the source 352.

If the door is subsequently opened, the arm 348 will be magnetically attracted to the terminal 346 whereupon the capacitor will discharge and apply a pulse to the transmitter 11 activating the same to transmit a pulse to the receiver circuit assembly 6. The transmission of the pulse by the transmitter 11 will render the burglar alarm system 5 operative and will activate the bell 308 in the manner described in detail hereinbefore.

Figure 6:
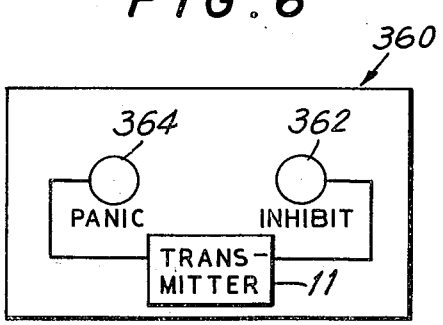
FIG. 6 is a schematic illustration of a keycase to be used in conjunction with the burglar alarm system depicted in FIG. 1 and more particularly in conjunction with the transmitter thereof.

With reference now to FIG. 6, there is shown a key case generally designated by the reference numeral 360, which key case is adapted to be used in conjunction with the burglar alarm system 5 depicted in FIG. 1. Those people to whom it is desired to give access to the premises protected by the burglar alarm system, are supplied with a key case 360 wherein the keys to open the protected premises are kept. The key case is provided with a first button 362 termed an inhibit button and a second button 364 termed a panic button, both of the buttons being connected to a transmitter 11. When it is desired to gain access to the premises protected by the burglar alarm system 5 when the system is in operative condition, the person having the key case 360, prior to opening the door with the key, presses the inhibit button 362 which transmits a pulse to the output circuit 8 and inactivates the bell 308 for a predetermined period of time, as described hereinbefore. The person may then open the door and enter the premises closing the door behind him. The interval of time within which the system is inactivated by the pressing of the inhibit button 362 is a matter of choice but in a preferred embodiment of the invention is adjusted to be anywhere between fifteen and thirty seconds. After this interval of time has transpired, the person will have had sufficient time to open the door and enter the premises and to close the door. After which time the burglar alarm system will then be operative to activate the bell 308 upon entry by an unauthorized person. If it is necessary to obtain a longer period of time within which to gain entry, prior to opening of the door, the button 362 may be depressed again and the bell will be inhibited for an additional time interval.

It is herein to be noted that it is also a feature of the present burglar alarm system to prevent an occupant of the premises protected by the system, from being surprised or attacked at the time they are entering the premises. In particular, it will be apparent that on many occasions women who are entering their home are surprised by attackers waiting at the door for them. With the burglar alarm system of the present invention, if an occupant of the premises prior to entering the premises, and prior to activating the inhibit button 362, sees an attacker or is actually attacked, she may then push the panic button 364 which will immediately trigger the alarm system and activate the bell 308 thereof.

It is herein to be noted that once the bell 308 has been activated, there is no way to shut the same off except by means of the key switch 316. The actual housing for the receiver circuit assembly 6, wherein the key switch 316 is disposed, also has traps (not shown) which will activate the bell 308 if someone tries to open the housing other than by means of the keyswitch 316.

Although the burglar alarm system 5 has been described in detail to describe the inhibiting action of the output circuit 8 upon the output circuit 9 and thus the warning device 10, it should be noted that this permits authorized entry from outside the premises into the premises. The system 5 also permits the occupants of the premises to open the doors or windows from inside the premises and leave them open for indeterminate periods of time, should they so desire.

It will be appreciated that once the inhibit button 362 on the keycase 360 (FIG. 6) is activated, the warning device, and in particular the bell 308, cannot be activated for a period of fifteen to thirty seconds, as predeterminedly selected. Thus, if someone appears at the door of the premises and desires to see the occupant thereof, the occupant may then depress the inhibit button 362 and open the door. It will, of course, be apparent that in many instances the door will, of necessity, remain opened or left ajar for periods far in excess of thirty seconds. With the present system, no difficulty is encountered since once the door is opened, after the button 362 is depressed, the capacitor 350 (FIG. 5) will pulse the transmitter 11 which will send a signal to the output circuit 9 which signal will have no effect since output circuit 9 is temporarily inhibited by the output pulse from output circuit 8. The transmitter 11 cannot thereafter transmit any signals until the door is again reclosed and then reopened since the battery 352 is not connected to the transmitter 11 but to the capacitor 350, and once the capacitor 350 has discharged to pulse the transmitter 11 upon opening of the door, the door may remain open for an indeterminate period of time without activating the bell 308. Similarly, if it is desired to leave an upstairs back window open, the window may also be opened after depressing the button 362 and be left open without activating the alarm bell 308 and without any drain on the battery 352.

Thus, while we have shown and described the preferred embodiments of our invention, there are many changes, improvements and modifications which may be made therein without departing from the spirit and scope thereof as defined in the appended claims.

What is claimed is:

1. A wireless burglar alarm system comprising a wireless transmitter, and a receiver, a first output circuit connected to said receiver and responsive to a first predetermined frequency, a second output circuit connected to said receiver and responsive to a second predetermined frequency, warning means connected to said second output circuit as a load thereof, said first output circuit being connected to said second output circuit, said transmitter being selectively operable to transmit signals having one of said first and second predetermined frequencies, said receiver being operable upon the reception of an input signal from said transmitter to produce an output signal having one of said first and second predetermined frequencies, said second output circuit being selectively operable upon the application of said output signal from said receiver at said second predetermined frequency to activate said warning means, and said first output circuit being operable upon the application of said output signal from said receiver at said first predetermined frequency to inhibit the operation of said second output circuit and said warning means.

2. A wireless burglar alarm system in accordance with claim 1, wherein said first output circuit includes means to inhibit the operation of said second output circuit for a predetermined period of time within which period of time said second output circuit is ineffective to activate said warning means upon the application of said second predetermined frequency signal to said second output circuit.

3. A wireless burglar alarm system in accordance with claim 2, wherein said transmitter is operable to transmit and said receiver is operable to receive a double modulated rf carrier signal having a low frequency modulating signal, and said receiver is operable to demodulate said carrier signal to produce said low frequency signal as the output signal thereof.

4. A wireless burglar alarm system in accordance with claim 3, wherein said double modulated signal comprises an rf carrier wave component, a mid-range audio frequency component and a low frequency component, and wherein said receiver includes means to demodulate said double modulated rf carrier signal to produce said low frequency component as the sole output signal thereof.

5. A wireless burglar alarm system in accordance with claim 2, wherein said warning means is an audible warning device.

6. A wireless burglar alarm system in accordance with claim 5, wherein said second output circuit includes selectively operated switch means to deactivate said audible warning device after activation thereof.

7. A wireless burglar alarm system in accordance with claim 1, wherein said second output circuit comprises an input stage, and an output stage, said warning means being connected as a load to said output stage, and said input stage including frequency selective means to pass to said output stage substantially only those output signals from said receiver whose frequency is said second predetermined frequency.

8. A wireless burglar alarm system in accordance with claim 7, wherein said input stage includes a first transistor having first, second and third terminals, a transformer having primary and secondary coils, and a potential source, said second and third terminals being adapted to have said receiver output signal applied thereacross and to produce a transistor output signal across said first and third terminals, said frequency selective means including said transformer, said primary coil being connected between said potential source and said first terminal, said frequency selective means also including a capacitor connected in parallel across said primary coil and forming therewith a resonant circuit tuned to said second predetermined frequency, and means for connecting said secondary coil to said output stage.

9. A wireless burglar alarm system in accordance with claim 8, including a second capacitor connected in parallel across said secondary coil and forming therewith a second resonant circuit tuned to said second predetermined frequency, and said first resonant circuit and said second resonant circuit comprising said frequency selective means.

10. A wireless burglar alarm system in accordance with claim 9, wherein said first transistor terminal is the collector, said second transistor terminal is the base, and said third transistor terminal is the emitter.

11. A wireless burglar alarm system in accordance with claim 10, wherein said warning means is activated when said second output circuit is in an activated condition and inactivated when said second output circuit is in its inactivated position.

12. A wireless burglar alarm system in accordance with claim 11, wherein said first output circuit comprises an input stage, and an output stage, means connecting said output stage of said first output circuit to said output stage of said second output circuit, and said last mentioned input stage including frequency selective means to pass to said output stage of said first output circuit substantially only those output signals from said receiver whose frequency is said first predetermined frequency.

13. A wireless burglar alarm system in accordance with claim 12, wherein said last mentioned input stage includes a second transistor having first, second and third terminals, a second transformer having a second primary and a second secondary coil, and a second potential source, said second and third terminals being adapted to have said receiver output signal applied thereacross and to produce a transistor output signal across said first and third terminals, said second primary coil being connected between said second potential source and said first terminal, said frequency selective means comprising said second primary coil and a second capacitor connected in parallel across said second primary coil and forming therewith a resonant circuit tuned to said first predetermined frequency, and means for connecting said second secondary coil to said output stage.

14. A receiver circuit assembly for use with burglar alarm systems, said assembly comprising a receiver, a first output circuit connected to said receiver and responsive to a first predetermined frequency, a second output circuit connected to said receiver and responsive to a second predetermined frequency, warning means connected to said second output circuit as the load thereof, said receiver being operable to produce an output signal having one of said first and second predetermined frequencies upon the reception of an input signal thereto, said first output circuit being connected to said second output circuit, said second output circuit being selectively operable upon the application of said output signal from said receiver at said second predetermined frequency to activate said warning means, said first output circuit being operable upon the application of said output signal from said receiver at said first predetermined frequency to inhibit the operation of said second output circuit and said warning means, said second output circuit comprising
an input stage, and
an output stage, said warning means being connected as a load to said output stage, said input stage including frequency selective means to pass to said output stage substantially only those output signals from said receiver whose frequency is said second predetermined frequency, said output stage having an activated and an inactivated condition and said warning means being activated when said output stage is in its activated condition and inactivated when said output stage is in its inactivated condition, said output stage comprising
a triggering device,
a trigger activating switch, and
a load activating switch, means connecting said input stage to said trigger activating switch, means connecting said trigger activating switch to said triggering device, means connecting said triggering device to said load activating device, means connecting said load activating device to said load, said trigger activating switch being adapted to be actuated upon the application of an output signal from said input stage at said second predetermined frequency, and actuation of said trigger activating switch actuating said triggering device and said load activating switch to thereby activate said load.

15. A receiver circuit assembly in accordance with claim 14, wherein said trigger activating switch includes
a first transistor having first, second and third terminals, and
a potential source, said potential source being connected to said first terminal, said second and third terminals being adapted to have the output signal from said input stage applied thereacross and to produce an output signal across said first and third terminals when said input stage output signal is at said second predetermined frequency.

16. A receiver circuit assembly in accordance with claim 15, wherein said triggering device is an SCR comprising
an anode,
a cathode, and
a gate, a voltage source connected to said anode, said means connecting said trigger activating switch to said triggering device comprising a relay including
a coil, and
a pair of normally open contacts, said coil being connected between said potential source and the first terminal of said first transistor, and said normally open contacts being connected between said voltage source and said gate, whereby when said transistor conducts said normally open contacts are closed to cause current flow to the gate of said SCR causing the same to fire.

17. A receiver circuit assembly in accordance with claim 16, wherein said load activating switch comprises a second relay including
a second coil, and
at least a pair of normally open contacts, said second relay coil being connected between said cathode and a ground terminal, and said last mentioned normally open contacts being effectively connected between said load and one terminal of said voltage source, whereby firing of said SCR causes current flow through said second relay coil causing said last mentioned normally open contacts to close to thereby connect said voltage source across said load and activate the same.

18. A receiver circuit assembly in accordance with claim 17, wherein said output stage includes selectively operable switch means connected to said load for selectively deactivating said load after activation thereof.

19. A receiver circuit assembly in accordance with claim 18, wherein said selectively operable switch means comprises a keyswitch.

20. A receiver circuit assembly in accordance with claim 19, wherein said keyswitch is connected to said voltage source and is operable to disconnect said voltage source from said load and said SCR.

21. A receiver circuit assembly in accordance with claim 17, wherein said warning means comprises an audible warning device.

22. A receiver circuit assembly in accordance with claim 17, wherein said output stage includes a third relay comprising
a third coil, and
a pair of normally closed contacts, said coil being effectively connected to said potential source, said last mentioned normally closed contacts being connected in parallel across said normally open contacts of said first relay, said last mentioned normally closed contacts being maintained in an open condition by the flow of current from said potential source through said third coil and returning to said normally closed position upon the cessation of current flow through said third coil, thereby firing said SCR and activating said load.

23. A receiver circuit assembly in accordance with claim 20, wherein said first transistor terminal is the collector, said second transistor terminal is the base, and said third transistor terminal is the emitter.

24. a receiver circuit assembly in accordance with claim 17, wherein said input stage includes
a second transistor having first, second and third terminals,
a transformer having primary and secondary coils, and
a second potential source,
said second and third terminals being adapted to have said receiver output signal applied thereacross and to produce a transistor output signal across said first and third terminals,
said frequency selective means including said transformer,
said primary coil being connected between said second potential source and said first terminal,
said frequency selective means also including a capacitor connected in parallel across said primary coil and forming therewith a resonant circuit tuned to said second predetermined frequency, and
means for connecting said secondary coil to said output stage.

25. A receiver circuit assembly in accordance with claim 24, including
a second capacitor connected in parallel across said secondary coil and forming therewith a second resonant circuit tuned to said second predetermined frequency, and
said first resonant circuit and said second resonant circuit comprising said frequency selective means.

26. A receiver circuit assembly in accordance with claim 25, wherein
said first transistor terminal is the collector,
said second transistor terminal is the base, and
said third transistor terminal is the emitter.

27. A receiver circuit assembly in accordance with claim 25, wherein
said first output circuit comprises
an input stage, and
an output stage,
said output stage comprises
a second triggering device,
a second trigger activating switch, and
an inhibiting switch means,
means connecting said input stage to said second trigger activating switch,
means connecting said second trigger activating switch to said second triggering device,
means connecting said second triggering device to said inhibiting switch means, and
means connecting said inhibiting switch means to said second output stage,
said second trigger activating switch being adapted to be actuated upon the application of an output signal from said input stage and said first predetermined frequency, and
actuation of said second trigger activating switch actuating said second triggering device and said inhibiting switch means to thereby inhibit said second output stage and maintain the same in an inactivated condition.

28. A receiver circuit assembly in accordance with Claim 27, wherein
said first output stage includes a timing circuit,
means connecting said timing circuit to said second triggering device, and
said timing circuit being operative upon the actuation of said second triggering device to commence its timing cycle and operative upon the completion of its timing cycle to deactuate said second triggering device and said inhibiting switch means to thereby uninhibit said second output stage.

29. A receiver circuit assembly in accordance with Claim 28, wherein
said timing circuit is reset to commence its timing cycle upon the application of another signal to said second trigger activating switch during said initial timing cycle and prior to the completion thereof so as to maintain said second output stage in its inhibited and inactivated condition.

30. A receiver circuit assembly in accordance with Claim 28, wherein
said second trigger activating switch includes
a third transistor having first, second and third terminals, and
a third potential source,
said third potential source being connected to said first terminal,
said second and third terminals being adapted to have the output signal from said input stage applied thereacross and to produce an output signal across said first and third terminals when said input stage output signal is at said first predetermined frequency.

31. A receiver circuit assembly in accordance with Claim 30, wherein
said second triggering device is a second SCR comprising
a second anode,
a second cathode, and
a second gate,
a second voltage source connected to said second anode,
said means connecting said second trigger activating switch to said second triggering device comprising
a fourth relay including
a fourth coil, and
a pair of normally closed contacts,
said fourth coil being connected between said third potential source and the first terminal of said third transistor.

32. A receiver circuit assembly in accordance with Claim 31, wherein
said inhibiting switch means comprises a fifth relay including
a fifth coil, and
a pair of normally closed contacts,
said fifth relay coil being effectively connected between said second cathode and a ground terminal,
said normally closed contacts of said fifth relay being connected to said first trigger activating switch, whereby firing of said second SCR causes current flow through said fifth relay coil causing said normally closed contacts of said fifth relay to open to thereby inhibit said first trigger activating switch and maintaining the output stage of said second output circuit and said warning means in an inactivated condition.

33. A receiver circuit assembly in accordance with Claim 32, wherein
said normally closed contacts of said fifth relay are connected between said third terminal of said first transistor and ground.

34. A receiver circuit assembly in accordance with Claim 33, wherein
said timing circuit is connected between the second cathode of said second SCR and a ground terminal, and said timing circuit is operable upon the firing of said second SCR to commence its timing cycle and operative upon completion of its timing cycle to cause said second SCR to cease conducting and to thereby return said second output circuit to its uninhibited condition.

35. A receiver circuit assembly in accordance with Claim 34, wherein said timing circuit is reset to commence its timing cycle upon the application of another signal to the second gate of said second SCR during said initial timing cycle and prior to the completion thereof so as to maintain said second output stage in its inhibited and inactivated condition.

36. A receiver circuit assembly in accordance with Claim 35, wherein said fourth relay includes a pair of normally opened contacts, said normally opened and normally closed contacts of said fourth relay having a common junction therebetween connected to one of each of said pairs of contacts and to a ground terminal, said timing circuit comprising a unijunction transistor having an emitter, a first base, and a second base, a first series connected resistance-capacitance circuit, and a second series connected resistance-capacitance circuit, said first resistance-capacitance circuit being connected between the second cathode of said second SCR and a ground terminal with the resistance being connected to said second SCR cathode and said capacitance being connected to ground, the junction between said last mentioned resistance and said last mentioned capacitance being connected to said first base, and a resistor connected between said second base and said second SCR cathode.

37. A receiver circuit assembly in accordance with Claim 32, wherein said second relay includes a pair of normally closed contacts, and said last mentioned normally closed contacts being connected between one terminal of said fifth relay coil and said ground terminal.

38. A receiver circuit assembly in accordance with Claim 32, wherein said receiver is adapted to receive a double modulated carrier signal having a high frequency component, a midfrequency component and a low frequency component, said receiver comprising an input stage, a first intermediate stage, a second intermediate stage, and an output stage, first means connecting said first intermediate stage to said input stage, second means connecting said input stage to said first intermediate stage, third means connecting said input stage to said second intermediate stage, fourth means connecting said second intermediate stage to said output stage, said input stage including frequency selective means tuned to said high frequency component of said double modulated carrier signal, said input stage being adapted to pass to said first intermediate stage said double modulated carrier signal, said first intermediate stage being operable upon the reception of said double modulated carrier signal to produce an output signal, said first means connecting said first intermediate stage to said input stage including means to prevent the passage therethrough of said high frequency component, thereby demodulating said double modulated carrier signal and presenting a single modulated carrier signal to said input stage, said input stage being operable upon the reception of said single modulated carrier signal to produce an output signal which is passed to said second intermediate stage through said third connecting means, and thence to said output stage through said fourth connecting means, and said output stage including means to demodulate said single modulated carrier signal, thereby producing said low frequency component as the output signal thereof.

39. A receiver circuit assembly in accordance with Claim 38, wherein said first intermediate stage is operable to amplify the input signal applied thereto.

40. A receiver circuit assembly in accordance with Claim 39, wherein said third means includes blocking means to prohibit the passage of said double modulated carrier signal from said input stage to said second intermediate stage.

41. A receiver circuit assembly in accordance with Claim 40, wherein said first intermediate stage comprises an oscillator having an output tank tuned to the frequency of said high frequency component of said carrier wave, and said second means is connected from the output of said input stage to said tuned tank.

42. A receiver circuit assembly in accordance with Claim 41, wherein said first means is interconnected between the output of said oscillator and said input stage and includes a choke, and a bypass capacitor, said bypass capacitor having one terminal thereof connected to said choke and the other terminal thereof connected to ground.

43. A receiver circuit assembly in accordance with claim 42, wherein said fourth means includes a waveshaping network, and a frequency selective network, and said frequency selective network being tuned to said mid-frequency to permit the passage therethrough of said single modulated carrier signal at said mid-frequency.

44. A receiver circuit assembly in accordance with Claim 43, wherein said frequency selective network comprises an inductor and a capacitor, said inductor and said capacitor being connected in series and forming a series tuned network.

45. A receiver circuit assembly in accordance with Claim 44, wherein said input stage includes a fourth transistor having first, second and third terminals, said second and third terminals being adapted to have said double modulated carrier signal applied thereacross and to produce an output signal across said first and second terminals, and said last mentioned output signal being applied to the tuned tank of said oscillator through said second means.

46. A receiver circuit assembly in accordance with claim 45, wherein said oscillator output is fed through said first means and applied across said second and third terminals of said fourth transistor to produce an output signal across said first and third terminals thereof, and said last mentioned output signal being fed to said second intermediate stage through said third means.

47. A receiver circuit assembly in accordance with Claim 46, wherein said first transistor terminal is the collector, said second transistor terminal is the base, and said third transistor terminal is the emitter.

48. A receiver circuit assembly in accordance with Claim 47, wherein said frequency selective means comprises a second inductor, and a second capacitor, said second inductor and said second capacitor being connected in parallel between said emitter and a ground terminal.

49. A receiver circuit assembly in accordance with Claim 48, wherein said blocking means of said third means comprises a second choke, and a second bypass capacitor, said second choke being connected between said collector and said second intermediate stage, and said second bypass capacitor being connected between the terminal of said second choke remote from said collector and ground.

* * * * *